United States Patent [19]

Groom et al.

[11] 4,358,918

[45] Nov. 16, 1982

[54] CARTONING APPARATUS

[75] Inventors: James S. Groom, Wales, Mass.; Robert W. McIntyre, Kennewick, Wash.

[73] Assignee: Package Machinery Company, East Longmeadow, Mass.

[21] Appl. No.: 123,824

[22] Filed: Feb. 22, 1980

[51] Int. Cl.[3] ..... B65B 43/24; B65B 5/00

[52] U.S. Cl. ..... 53/74; 53/252; 53/566

[58] Field of Search ..... 53/251, 252, 258, 259, 53/260, 566, 442, 444, 458, 473, 56, 64, 284, 74; 198/689; 493/101

[56] References Cited

U.S. PATENT DOCUMENTS

| | | | |
|---|---|---|---|
| 2,934,869 | 5/1960 | Engleson et al. | 53/252 X |
| 3,105,337 | 10/1963 | Clanin et al. | 53/251 |
| 3,370,549 | 2/1968 | Livington | 53/252 X |
| 3,490,192 | 1/1970 | Regan, Jr. | 53/432 X |
| 3,807,655 | 4/1974 | Bull | 406/147 |
| 3,889,801 | 6/1975 | Boyer | 198/689 |
| 4,052,931 | 10/1977 | Morse et al. | 493/101 |
| 4,062,169 | 12/1977 | Lister et al. | 53/473 X |
| 4,081,945 | 4/1978 | Calvert et al. | 53/566 |
| 4,136,505 | 1/1979 | Putnam, Jr. et al. | 53/551 |

FOREIGN PATENT DOCUMENTS

| | | | |
|---|---|---|---|
| 1208606 | 10/1970 | United Kingdom | 53/251 |

*Primary Examiner*—R. L. Spruill
*Assistant Examiner*—K. Y. Lin
*Attorney, Agent, or Firm*—McCormick, Paulding & Huber

[57] ABSTRACT

Cartoning apparatus for packaging sealed bags containing loosely packed discrete articles in board cartons comprises a carton transfer and erecting mechanism which withdraws a collapsed carton sleeve from a magazine and deposits it in erected condition on a carton conveyor which advances the erected carton sleeve with step-by-step motion through a pluraltiy of work stations. A form, fill and seal machine delivers a sealed bag containing a product to a vacuum conveyor which accelerates the bag through a guide shroud and into the near open end of an associated carton sleeve supported on the carton conveyor at a carton filling station. A rail disposed at the far open end of the associated carton sleeve arrests the bag within the sleeve. The carton conveyor advances the carton sleeve and bag to further work stations where the carton end flaps are closed and sealed. Another embodiment of the invention utilizes a vacuum head at the filling station adjacent the far open end of the associated sleeve to draw vacuum on the interior of the sleeve and thereby assist movement of a bag into the carton sleeve.

13 Claims, 8 Drawing Figures

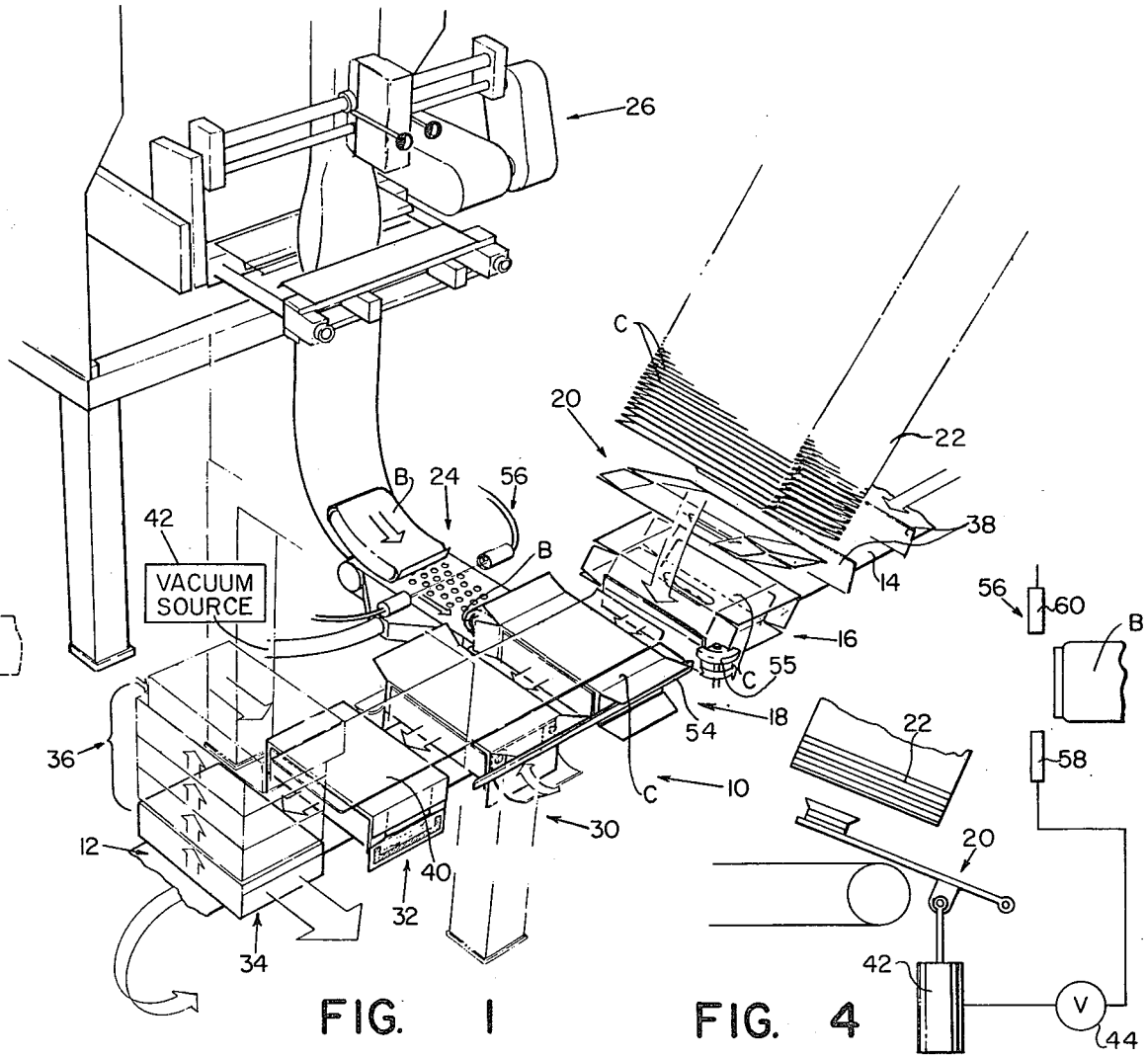
FIG. 1
FIG. 4
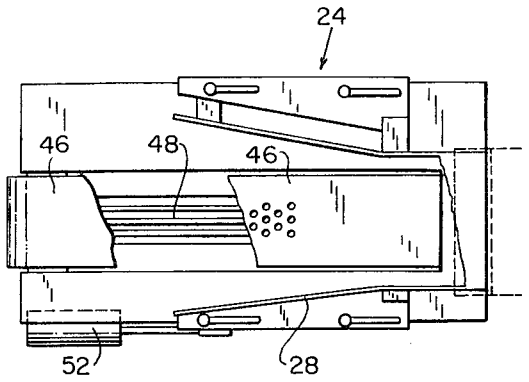
FIG. 2
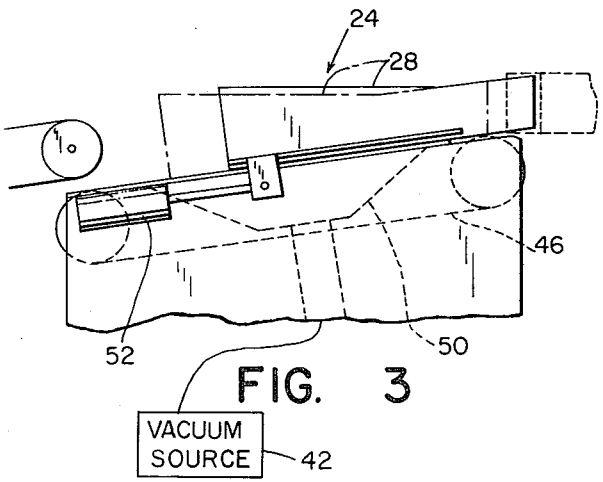
FIG. 3

CARTONING APPARATUS

BACKGROUND OF THE INVENTION

This invention relates in general to packaging apparatus and deals more particularly with an improved cartoning machine for packaging filled, sealed bags or pouches in board cartons. The present apparatus is particularly adapted for packaging bags or pouches containing discrete loosely packed products which may be fragile and may, for example, be used for packaging bags of food products which range in weight from one ounce to one pound, such as potato chips, crackers and like snacks. Heretofore, such cartoning apparatus has usually utilized some form of mechanical pusher mechanism for inserting a bagged product into a carton. However, such a pusher mechanism is not wholly satisfactory for loading a bagged product of the aforedescribed type, because of the tendency of the pusher mechanism to compact the product or cause uneven product distribution within the bag. The problem associated with carton loading by pusher mechanism may be compounded when bagged products are delivered to a cartoning apparatus from a vertical form, fill and seal machine. Since bags are usually gravity filled in a vertical form, fill and seal machine there is a natural tendency for a discrete loosely packed product to accumulate within the lower portion of each bag resulting in an uneven distribution of product within the bag. When the bag is thereafter forced into a carton by a pusher mechanism further compacting of the product within one end of the bag may result. This uneven distribution of a bagged product often leads a consumer to conclude that a bag has been only partially filled resulting in consumer complaint. The present invention is concerned with this problem.

SUMMARY OF THE INVENTION

In accordance with the present invention a bag containing a product is moved into one open end of a carton sleeve while vacuum applied to the bag assists in moving it into the carton sleeve. A cartoning machine is provided which comprises a carton conveyor having a plurality of carton confining receptacles, drive means for advancing the carton conveyor to move each successive carton conveying receptacle to and through a plurality of stations which include a carton receiving station and a carton filling station, means for depositing an erected carton sleeve in each successive carton confining receptacle at the carton receiving station, bag guiding means disposed laterally of the carton conveyor and at the carton filling station for directing a bag into an open end of an associated carton sleeve at the filling station, bag transfer means for moving a bag through the bag guiding means and into the open end of the associated carton sleeve, and vacuum means for assisting movement of the bag from the bag guiding means and into the associated carton sleeve.

BRIEF DESCRIPTION OF THE DRAWINGS

FIG. 1 is a somewhat schematic perspective view of a cartoning apparatus embodying the invention and illustrates a method for packaging sealed bags or pouches in cartons in accordance with the invention.

FIG. 2 is a somewhat enlarged fragmentary plan view of the bag transfer mechanism and bag guide shroud of the machine of FIG. 1.

FIG. 3 is a fragmentary side elevational view of the bag transfer mechanism and bag guide shroud.

FIG. 4 is a schematic view of the carton transfer mechanism and associated bag sensing device.

DETAILED DESCRIPTION OF PREFERRED EMBODIMENTS

Figure 5:
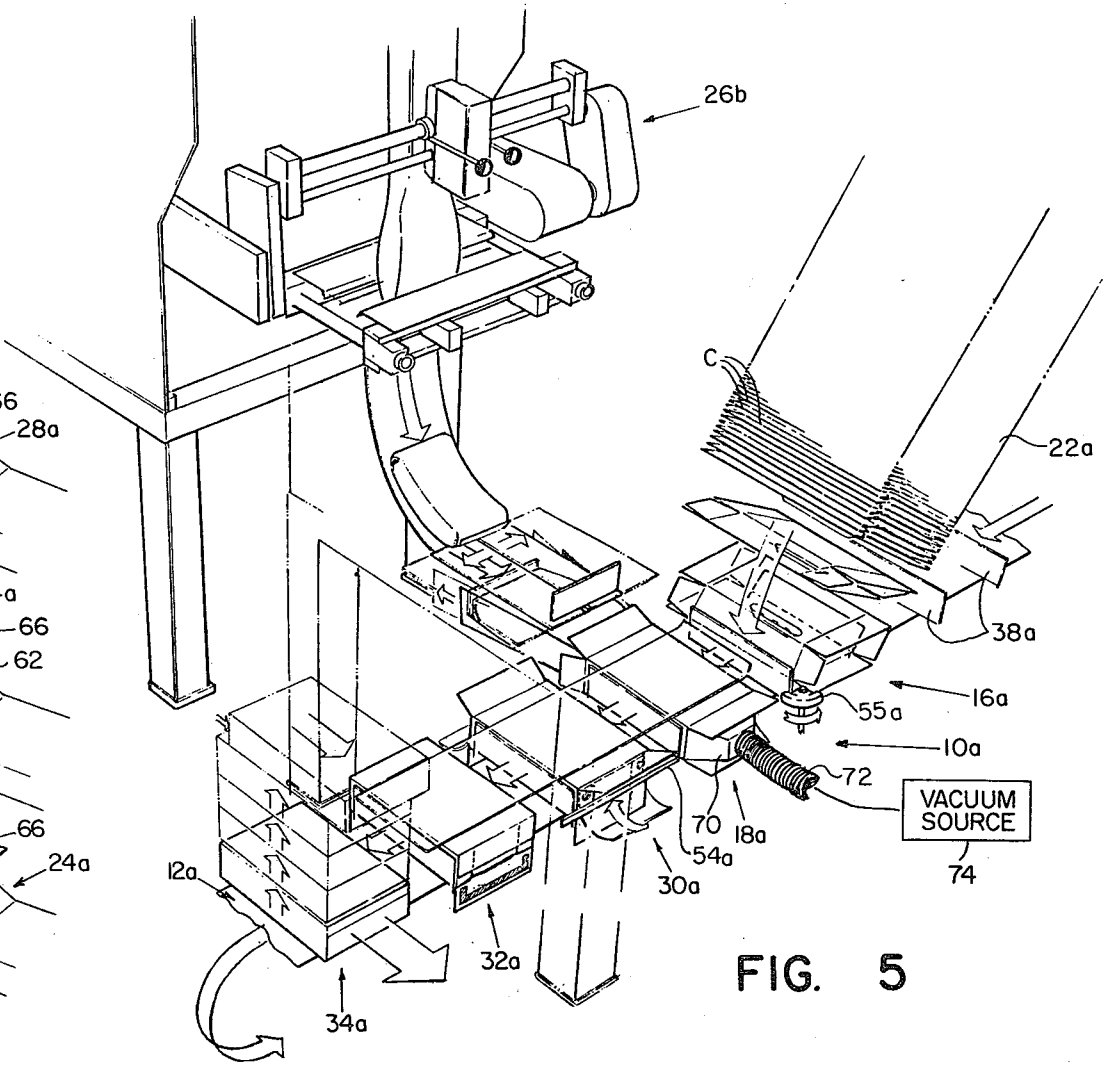
FIG. 5 is similar to FIG. 1 but shows another cartoning apparatus and illustrates a further packaging method in accordance with the invention.

Turning now to the drawings, a cartoning apparatus which embodies the present invention and which illustrates a packaging method in accordance with the invention is shown somewhat schematically and indicated generally by the reference numeral 10 in FIG. 1. The apparatus 10 is particularly adapted for packaging bagged products in cartons and includes a carton conveyor, designated generally at 12, which has a plurality of spaced apart carton confining receptacles 14, 14. The conveyor 12 is driven with a step-by-step motion to move each successive carton confining receptacle 14 to and through a plurality of work stations which include a carton receiving station, indicated generally at 16, and a carton filling station, designated generally by the numeral 18. A carton transfer mechanism indicated generally at 20 withdraws collapsed carton sleeves C, C from a carton magazine 22 and deposits each successive carton sleeve C in an erected condition on the carton conveyor 12 at the carton receiving station 16 and within an associated carton confining receptacle 14. A bag transfer mechanism, indicated generally at 24 and disposed laterally of the carton conveyor 12, receives sealed bags B, B, containing products, delivered by a vertical form, fill and seal machine indicated generally at 26, and moves each successive bag B through a guide shroud 28, shown in FIGS. 2 and 3, and into an associated carton sleeve C at the carton filling station 18. In accordance with the invention, vacuum is applied to each bag B to aid in moving it into an associated carton sleeve C, as will be hereinafter more fully discussed.

Each carton sleeve C with a bag B therein is moved by the conveyor 12 from the carton filling station 18 to and through successive additional stations, as for example the stations indicated generally at 30 and 32, where end flap closing and sealing operations are completed to finish the package. The package is ultimately conveyed to an ejection station 34 where it may be directly discharged from the machine 10. An optional solvent glue drying station, indicated generally at 36, may be provided, if desired, to allow drying time for glue on the carton closing flaps before the finished package is ejected from the apparatus 10.

Considering the apparatus 10 in further detail, the illustrated carton conveyor 12 comprises an endless belt conveyor and has a plurality of flight bars 38, 38 which define the various carton confining receptacles 14, 14. One or more stationary members, which may comprise parallel rails or a plate, such as indicated at 40, mounted above the carton conveyor 12 cooperate with the flight bars 38, 38 to further confine the cartons at the work stations 18, 30 and 32, substantially as shown. The conveyor 12 is preferably driven by a Geneva mechanism (not shown) which imparts in intermittent or step-by-step motion to the conveyor 12 in a manner well known in the art.

The carton transfer mechanism 20, which is illustrated somewhat schematically in FIG. 4, includes a reciprocally movable vacuum pick-up arm assembly which operates to withdraw a collapsed carton sleeve C from the bottom of the adjustable carton magazine 22 and deposit the sleeve C in an erected condition on the carton conveyor 12 and within an associated carton confining receptacle 14. The carton transfer mechanism is preferably operated by a fluid motor or air cylinder 42 controlled by an electrically operated fluid control valve 44, as will be hereinafter further discussed.

Referring now particularly to FIGS. 2 and 3 the illustrated bag transfer mechanism 24 includes an endless perforated conveyor belt 46 supported at the filling station 18 to travel in a path generally normal to the path of the carton conveyor 12. The upper run of the belt 46 is supported on a grid 48 and is inclined upwardly and in the direction of the conveyor 12, as shown in FIG. 3, for a reason which will be hereinafter further evident. A vacuum head 50 mounted below the grid 42 is connected to a vacuum source, such as the diagrammatically illustrated vacuum source 42, and communicates with the upper surface of the belt 46 through the grid 48 and through the perforations or apertures in the belt 46 whereby vacuum may be drawn on an associated portion of the upper surface of the belt 46.

The bag guide shroud 28 is supported above the conveyor belt 46 for guiding a bag B from the conveyor and into an associated carton sleeve C at the filling station 18. It is or may be adjustable to accommodate bags of varying size and has a top wall and opposing side walls which generally converge in the direction of the carton conveyor 12. A fluid motor or air cylinder 52 moves the guide shroud 28 generally toward and away from the carton conveyor 12 in timed relation to the operation of the conveyor 12, as will be hereinafter further discussed.

An arresting rail 54 is mounted at the filling station 18 and at the opposite side of the carton conveyor 12 from the bag transfer mechanism 24. The rail 54 extends through the stations 18 and 30 and is disposed generally adjacent the far end of an associated carton sleeve C at the carton filling station 18 to arrest movement of a bag B which is moved into the near open end of the sleeve by the conveyor belt 46. The rail 54 may also function to engage and close the leading side flap at the far end of a carton sleeve as the sleeve is moved from the carton receiving station 16 to the carton filling station 18 by the carton conveyor 12. A rotary side flap closing device, indicated at 55 operates to engage and close the trailing side flap at the far end of the carton sleeve on the fly as the sleeve moves toward the carton filling station 18.

The illustrated machine 10 also includes a sensing device indicated generally at 56 for controlling the operation of the carton transfer mechanism so that a carton sleeve C will not be deposited on the carton conveyor 12 unless a corresponding bag B has first been delivered to the bag transfer mechanism 24. The sensing device may take various forms and may, for example, comprise a simple electrical switch which has an actuator in the path of bag travel. However, the illustrated sensing device 56 generally comprises a photoelectric cell 58 and an associated light source 60 mounted at opposite sides of the conveyor belt 46 and in the path of travel of bags B, B from the form, fill and seal machine 26. The photoelectric cell 58 is connected in an electrical circuit with the electrically operated control valve 44 which controls the air cylinder 42 for operating the carton transfer mechanism 20.

The Geneva drive for the carton conveyor 12 operates continuously to advance the carton conveyor with an intermittent motion. Bags B, B formed in the form, fill and seal machine 26 and loaded from above are successively delivered by the machine 26 to the bag transfer mechanism 24 with the bottom end of each bag B in a leading position. As each bag B moves into the conveyor belt 46 the vacuum head 50 draws the bag into engagement with the upper surface of the belt thereby holding the bag firmly in engagement with the conveyor belt. When an erected carton sleeve C has been positioned at the filling station 18, the conveyor 12 stops and the air cylinder 52, which operates in timed relation with the conveyor 12 moves the guide shroud 28 toward the carton conveyor and to a position adjacent the near open end of an associated carton C at the filling station 18. The conveyor belt accelerates the bag B along its upwardly inclined path through the guide shroud 28 and ultimately throws the bag into the near open end of the associated carton sleeve C at the filling station 18. As the bag B enters the near end of the carton sleeve the conveyor belt 46 is approaching its return path, so that the vacuum grip of the belt 46 upon the bag B is broken. The rapid upwardly travel of the bag B through the constricting guide shroud 28 causes some shifting or redistribution of the product within the bag from the leading bottom end of the bag toward the trailing top end. The arresting rail 54 effectively prevents the bag from being thrown through the carton sleeve or to a position beyond the far open end of the sleeve. When the bag B is properly positioned within the carton at the filling station the guide shroud 28 is retracted to its inactive position. The conveyor 12 then operates to move the filled carton sleeve from the filling station 18 to the next successive work station where further end flap closing and sealing operations are performed.

The sensing device 56 operates to detect movement of a bag B onto the bag transfer mechanism 24 in properly timed relation with the operation of the carton conveyor 12. The photoelectric cell 58 provides an output signal to effect operation of the control valve 44 which controls operation of the air cylinder 42 which, in turn, operates the carton transfer mechanism 20. If no signal is received from the sensing device 56 the air cylinder 42 will be disabled so that the next successive carton sleeve will not be withdrawn from the magazine 22 and deposited on the carton conveyor at the carton receiving station 16. However, the carton conveyor 12 will continue to operate until each carton sleeve C which has been properly filled moves successively through the work stations 30, 32 and 34, so that these packages will be completed. The electrical circuitry associated with the sensing device 56 is or may be so arranged that the machine 10 will shutdown when the last properly filled carton has been discharged from the conveyor 12 at the discharge station 34.

Referring now to FIGS. 5–8, another cartoning machine embodying the invention is indicated generally by the reference numeral **10*a*. The machine 10*a* is similar in many respects to the machine 10 previously described, but differs therefrom in the arrangement of the bag transfer and vacuum transfer mechanisms. Parts of the machine 10*a* which are substantially identical to parts of the machine 10**, previously described, bear the same reference numerals as the previously described parts and a letter a suffix and will not be hereinafter further described in detail.

Figure 6:
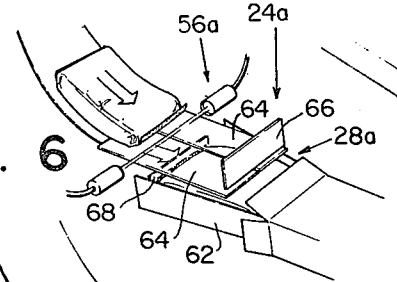
FIGS. 6–8 are fragmentary perspective views and illustrate successive positions of the bag transfer mechanism shown in FIG. 5.
Figure 7:
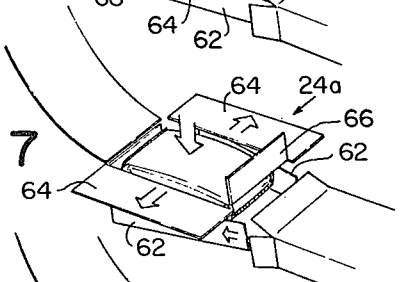
Figure 8:
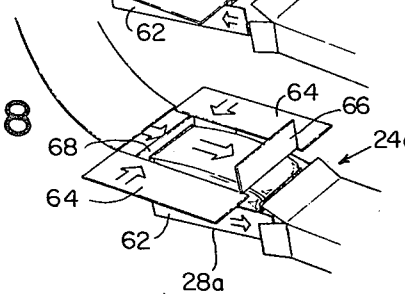

The machine 10*a* differs from the machine 10, previously described, in the construction and arrangement of the bag transfer means and the vacuum means for assisting movement of a bag into an associated carton sleeve at the carton filling station 18*a*. More specifically, the bag transfer means indicated generally at 24*a* and shown in FIGS. 5–8 includes a movable guide chute defined by a pair of transversely spaced guide plates 62, 62 and supported for movement generally toward and away from the carton conveyor 12*a*. A pair of bag support plates 64, 64 supported above the guide plates 62, 62, are arranged for movement toward and away from each other between open and closed positions, respectively, as shown in FIGS. 6–8. In closed position, shown in FIG. 6, the bag support plates 64, 64 cooperate with the guide plates 62, 62 to define a guide shroud 28*a*. A vertically disposed stop plate 66 is mounted in fixed position above and ahead of the support plates 64, 64 for arresting a bag B in proper delivery position on the bag support plates. The bag transfer mechanism 24*a* further includes a pusher plate 68 supported for limited reciprocating movement below the support plates 64, 64 and generally toward and away from the carton conveyor 12*a*, substantially as shown.

A vacuum head 70 is mounted at the filling station 18 and at the opposite side of the carton conveyor from the bag transfer mechanism 24*a* and is connected by a flexible hose 72 to a suitable vacuum source such as the vacuum source 74, diagrammatically illustrated in FIG. 5. The apparatus 10*a* also includes a sensing device indicated generally at 56*a* in FIG. 6 and substantially identical to the sensing device 56 previously discussed.

During a typical operational cycle the guide plates 62, 62 are in active position adjacent the near open end of an associated carton sleeve at the filling station 18*a*. A bag B disposed within the guide shroud 28*a*, as shown in FIGS. 5 and 6, is moved toward the near open end of the carton sleeve C at the filling station by the pusher plate 68. Since the vacuum head 70 operates continuously to draw a vacuum on the interior of the sleeve C it is only necessary for the pusher plate 68 to advance the bag at short distance so that its leading bottom end of the bag enters the near end of the carton sleeve to be filled. The vacuum head 70 then draws the bag and its contents the remaining distance into the carton sleeve while the next succeeding carton is being simultaneously delivered to the bag transfer mechanism 24*a* by the form, fill and seal machine 26*b*. When the sensing device 56*a* detects movement of a bag B onto the plates 64, 64, the air cylinder associated with the carton transfer mechanism 20*a* operates to deposit an erected carton sleeve on the carton conveyor.

The guide shroud 28 is retracted to allow the carton conveyor 12*a* to move the filled carton sleeve C from the filling station 18*a* to the next station 30*a* and to move the erected carton sleeve from the carton receiving station 16*a* to the carton filling station 18*a*. A rotary side flap closing device, indicated at 55*a* operates to engage and close the trailing side flap at the far end of the carton sleeve on the fly, as the carton sleeve is advanced from the carton receiving station 16 to the carton filling station 18. The leading side flap at the far end of the advancing carton sleeve is closed by engagement with the stationary flap closing member associated with the vacuum head, but not shown. After the conveyor 12 has indexed, the guide plates 62, 62 move to active position. The plates 64, 64 then move to open position to drop bag B into position between the guide plates 62, 62, whereupon the aforesaid operation is repeated.

The vacuum head 70 may be used in combination with any suitable bag transfer mechanism capable of positioning a bag at the entry or near open end of an associated carton sleeve. The vacuum head 70 may, for example, be substituted for the arresting rail 54 and used in combination with the bag transfer mechanism 24 shown in FIG. 1, and such arrangement is contemplated and is particularly advantageous for moving bags of heavier products.

We claim:

1. A cartoning machine comprising a carton conveyor, carton confining receptacles carried by said carton conveyor, drive means for advancing said carton conveyor to move each successive carton confining receptacle to and through a plurality of stations including a carton receiving station and a carton filling station, carton transfer means for depositing an erected carton sleeve in each successive carton confining receptacle at said carton receiving station, bag guiding means disposed laterally of said carton conveyor at said filling station for directing a filled bag into the near open end of an associated carton sleeve at said carton filling station, bag transfer means for moving a bag through said bag guiding means and feeding it into said carton through said open end, means for delivering a bag to said bag transfer means, and vacuum means for assisting movement of a bag through said guiding means and from said bag guiding means into the associated carton sleeve and including a vacuum head mounted adjacent said carton conveyor at said carton filling station and at the laterally opposite side of said carton conveyor from said bag guiding means for engaging the carton sleeve at its far open end to draw a vacuum on the interior of said carton sleeve.

2. A cartoning machine as set forth in claim 1 wherein said bag transfer means comprises a belt conveyor having a perforated belt and said vacuum means further comprises means for drawing a vacuum on the under side of said belt to draw a bag into engagement with said belt.

3. A cartoning machine as set forth in claim 2 wherein said belt conveyor is upwardly inclined in the direction of said carton conveyor.

4. A cartoning machine as set forth in either claim 2 or claim 3 wherein said cartoning machine includes means for moving said bag guiding means toward and away from said carton conveyor.

5. A cartoning machine as set forth in claim 4 wherein said bag guiding means comprises a bag shroud.

6. A cartoning machine as set forth in claim 1 wherein said machine includes bag stopping means at said carton filling station disposed laterally of said carton conveyor and at the opposite side of said carton conveyor from said bag guiding means for arresting a bag in a predetermined position within the associated carton sleeve.

7. A cartoning machine as set forth in claim 6 wherein said bag stopping means comprises an arresting rail mounted in fixed position generally adjacent said carton conveyor.

8. A cartoning machine as set forth in claim 1 including sensing means for detecting delivery of a bag by said delivering means and means responsive to said sensing means for operating said carton transfer means in response to the detection of a bag delivery by said sensing means.

9. A cartoning machine as set forth in claim 1 wherein said bag guiding means comprises a bag shroud defined by a pair of spaced apart guide plates and a pair of bag support plates supported above said guide plates and arranged for movement toward and away from each other between open and closed positions, said support plates in said closed position defining a portion of said bag shroud and an upwardly facing bag supporting surface above said shroud, said plates upon movement to said open position allowing a bag on said supporting surface to drop to a position between said guide plates.

10. A cartoning machine as set forth in claim 9 wherein said pair of guide plates are supported for movement generally toward and away from said carton conveyor.

11. A cartoning machine as set forth in claim 9 wherein said bag transfer means includes a pusher plate supported below said support plates for limited reciprocal movement generally toward and away from said carton conveyor.

12. A cartoning machine as set forth in claim 9 including means responsive to movement of a bag onto said supporting surface for operating said carton transfer means.

13. A cartoning machine comprising a carton conveyor, carton confining receptacles carried by said carton conveyor, drive means for advancing said carton conveyor to move each successive carton confining receptacle to and through a plurality of stations including a carton receiving station and a carton filling station, carton transfer means for depositing an erected carton sleeve in each successive carton confining receptacle at said carton receiving station, bag guiding means disposed laterally of said carton conveyor at said filling station for directing a bag into an open end of an associated carton sleeve at said carton filling station, bag conveying means for moving a bag through said bag guiding means and into said open end, means for delivering a bag to said bag conveying means, and vacuum means for assisting movement of a bag through said guiding means and from said bag guiding means into the associated carton sleeve including first vacuum means for drawing a bag into engagement with said bag conveying means and second vacuum means at said filling station and disposed laterally of said carton conveyor and at the opposite side of said carton conveyor from said bag guiding means for drawing a vacuum on the interior of the associated carton sleeve.

* * * * *